US009738446B2

(12) United States Patent
Rowland et al.

(10) Patent No.: US 9,738,446 B2
(45) Date of Patent: Aug. 22, 2017

(54) VERSATILE COLLECTION APPARATUS FOR FRONT LOADING REFUSE VEHICLE

(71) Applicant: Kann Manufacturing Corporation, Guttenberg, IA (US)

(72) Inventors: Jared Rowland, Dyersville, IA (US); Marlin Johnson, Guttenberg, IA (US); Kenneth D. Goedken, Dubuque, IA (US); Roger Taake, Elkader, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 26 days.

(21) Appl. No.: 14/013,293

(22) Filed: Aug. 29, 2013

(65) Prior Publication Data

US 2013/0343845 A1 Dec. 26, 2013

Related U.S. Application Data

(63) Continuation of application No. 12/818,445, filed on Jun. 18, 2010, now Pat. No. 8,550,764.

(Continued)

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01); *B65F 2003/0266* (2013.01);

(Continued)

(58) Field of Classification Search
CPC ..... B65F 2003/023; B65F 2003/0276; B65F 2003/0266; B65F 3/001; B65F 3/02;

(Continued)

(56) References Cited

U.S. PATENT DOCUMENTS 3,604,577 A * 9/1971 Heilmeier ..... 414/421
5,222,853 A 6/1993 Carson (Continued)

OTHER PUBLICATIONS

Jeremy Carroll, Godzilla born from exhaustion, Waste & Recycling News, Oct. 15, 2012, vol. 18 Issue 14, p. 0034, publisher Crain Communications Inc., Detroit, MI.

(Continued)

*Primary Examiner* — Glenn Myers
(74) *Attorney, Agent, or Firm* — Shuttleworth & Ingersoll, PLC; Brett Papendick

(57) ABSTRACT

A refuse collection assembly for a refuse collection vehicle mounts to a intermediate container on the refuse collection vehicle. The refuse receptacle collection assembly can grasp a refuse receptacle at curbside, at street side, or forward of the intermediate container in any location over a one hundred eighty degree arc. The collection assembly grasps the receptacle and locates it above the intermediate container and tilts it sufficiently to empty the contents of the receptacle in the intermediate container. The collection assembly then returns the receptacle upright to its previous location or to any location to the right, left or forward of the refuse collection assembly. The refuse receptacle collection assembly includes a rail extending along a wall of the intermediate container, a carriage selectively movable along the rail, and a receptacle engaging assembly supported by the carriage for grasping the refuse receptacle.

4 Claims, 13 Drawing Sheets

Related U.S. Application Data

(60) Provisional application No. 61/218,488, filed on Jun. 19, 2009.

(52) U.S. Cl.
CPC ..... *B65F 2003/0269* (2013.01); *B65F 2003/0273* (2013.01); *B65F 2003/0279* (2013.01)

(58) Field of Classification Search
CPC .. B65F 9/00; B65F 3/041; B65F 3/046; B65F 2003/0269; B65F 2003/0273; B65F 2003/0279; B65G 65/23; B60P 1/50; B60P 1/48
See application file for complete search history.

(56) References Cited

U.S. PATENT DOCUMENTS

| | | | | |
|---|---|---|---|---|
| 5,607,277 | A | 3/1997 | Zopf | |
| 5,639,201 | A | 6/1997 | Curotto | |
| 5,829,944 | A | 11/1998 | Szinte | |
| 5,833,428 | A | 11/1998 | Szinte | |
| 6,139,244 | A * | 10/2000 | VanRaden | 414/408 |
| 6,213,706 | B1 | 4/2001 | Christenson | |
| 6,474,928 | B1 | 11/2002 | Christenson | |
| 6,520,008 | B1 * | 2/2003 | Stragier | 73/168 |
| 6,846,148 | B2 | 1/2005 | Riba et al. | |
| 7,390,159 | B2 | 6/2008 | Rimsa et al. | |
| 7,871,233 | B2 | 1/2011 | Arrez et al. | |
| 8,092,141 | B2 | 1/2012 | Curotto et al. | |
| 2005/0111942 | A1 | 5/2005 | Rimsa et al. | |
| 2006/0280582 | A1 * | 12/2006 | Kouri | 414/408 |
| 2007/0243050 | A1 | 10/2007 | Arrez et al. | |

OTHER PUBLICATIONS

Kann Manufacturing Corporation, KDGHETTS, Kann CoCollector with Curotto Two Compartments Automated Carry Can #2, Nov. 24, 2010, YouTube Website video: http://www.youtube.com/watch?v=TW9fnFKnKQw&feature=channel.

* cited by examiner

VERSATILE COLLECTION APPARATUS FOR FRONT LOADING REFUSE VEHICLE

CROSS-REFERENCE TO RELATED APPLICATIONS

This application is a continuation of, and claims priority, from copending non-provisional application Ser. No. 12/818,445 titled VERSATILE COLLECTION APPARATUS FOR FRONT LOADING REFUSE VEHICLE which was filed Jun. 18, 2010, which claimed priority under 35 USC §119 from then copending provisional patent application entitled VERSATILE COLLECTION APPARATUS FOR FRONT LOADING REFUSE VEHICLE, Ser. No. 61/218,488, filed Jun. 19, 2009. The disclosures of provisional patent application Ser. No. 61/218,488 and of non-provisional application Ser. No. 12/818,445 are hereby incorporated in their entireties.

BACKGROUND OF THE INVENTION

The present invention relates to refuse collection vehicles for hauling waste and recyclable commodities. In particular, the present invention relates to a refuse collection vehicle having a storage body, an intermediate container for being unloaded into the storage body and an automated refuse receptacle collection assembly for engaging a refuse receptacle and unloading contents of the refuse receptacle into the intermediate container.

Residential refuse is typically contained in relatively small receptacles or containers such as cans or carts which are positioned along the street for pick-up by a refuse collection vehicle. Refuse collection vehicles generally include a storage body and a compactor for compacting refuse in the storage body. The refuse is either unloaded directly into the storage body or is unloaded into an intermediate container or "carry can" which, when full, is unloaded into the storage body.

Intermediate containers of refuse collection vehicles are typically loaded with refuse from the receptacles either manually or mechanically. Manual loading requires that an operator physically move, lift and tip the refuse receptacle over the intermediate container to unload refuse into the intermediate container. As a result, manual loading of an intermediate container is physically demanding and time consuming. Furthermore, manual loading of the intermediate container requires an operator to continuously board and depart the cab of the refuse collection vehicle at each individual collection site. Consequently, manual loading of the intermediate container is time consuming and inefficient.

Alternatively, the intermediate container may be mechanically loaded with refuse. Mechanical loading of the intermediate container is generally achieved using either a tipper or an automated collection assembly. With tippers, an operator must move the receptacle, typically a cart, into an aligned and engaged position with respect to the tipper. The tipper engages the receptacle and dumps the receptacle into the intermediate container for the operator. Although the tipper eliminates the need for the operator to lift and dump the receptacle into the intermediate container, the operator still must depart the refuse collection vehicle to move the refuse receptacle to connect it to the tipper.

In contrast to tippers which only lift and tilt the receptacle into the intermediate container, conventional automated collection assemblies additionally extend away from the intermediate container to engage refuse receptacles spaced from the intermediate container. For example, Zopf U.S. Pat. No. 5,484,245 discloses a side arm assembly including an extendable arm that linearly extends from a curbside of the intermediate container. Updike, Jr. U.S. Pat. No. 3,762,586 discloses a grab assembly that linearly extends forward of the intermediate container in front of the refuse collection vehicle. Because conventional collection assemblies can only extend in a single horizontal direction with respect to the intermediate container, conventional collection assemblies have an extremely limited range of motion. As a result, conventional automated collection assemblies require that the refuse collection vehicle itself be precisely positioned with respect to the refuse receptacle to align the collection assembly with the refuse receptacle for engagement. If the vehicle is not properly positioned with respect to the refuse receptacle, the vehicle must be repositioned or the operator must climb out of the vehicle to physically reposition the refuse receptacle in alignment with the collection assembly. In addition, conventional collection assemblies are incapable of collecting receptacles positioned on multiple sides of the intermediate container and are specifically configured for use only with a correspondingly configured refuse receptacle. Consequently, conventional automated collection assemblies are inflexible as to both the positioning and the particular type of receptacle being used.

An improvement to the loading of the intermediate container of a collection vehicle is disclosed in Szinte, U.S. Pat. No. 5,833,428 which shows a collection arm which rotates about an arc forward of the intermediate container and also includes a sideways telescoping structure to allow greater range of reach of the collection arm.

SUMMARY OF THE INVENTION

The present invention is a refuse collection vehicle for collecting refuse contained in refuse receptacles. The refuse collection vehicle includes a storage body, an intermediate container, an intermediate container dumping assembly supported proximate the storage body for lifting and emptying contents of the intermediate container into the storage body and an automated refuse receptacle collection assembly supported adjacent the intermediate container. In one embodiment, the automated refuse receptacle collection assembly includes a carriage which moves along a rail mounted to the intermediate container. A rotatable arm is carried on the carriage and may move over a range of one hundred eighty degrees. The arm includes a gripper mechanism which may capture a waste receptacle along a roadway or alley. The carriage is movable from one side of the intermediate receptacle to the other and is driven by a rotary motor with a pinion gear riding along a toothed rack. Another rotary motor moves the arm about the arc of movement.

The arm is articulated such that it can raise and dump the contents of a grasped receptacle into the intermediate container, and then return the emptied receptacle to the location from which it was removed, oriented in an upright position.

In a second embodiment, the receptacle collection assembly also includes a telescoping assembly which mounts to the intermediate container which is carried on lift arms of the refuse collection vehicle. The telescoping assembly allows the rail on which the arm carriage is slideable to be offset from the intermediate container in either direction. An elongate channel is mounted to the intermediate container and a slideable channel is slideable along the mounted channel by use of hydraulic cylinders. The slideable channel carries the rail on which the carriage may move. The carriage can move from end to end of the rail by operation of a pinion gear coupled to a toothed rack carried on the slideable channel. The articulated arm is moveable about a 180 degree arc forward of the rail by use of an upright hydraulic rotary actuator. A gripping mechanism is carried on the end of the articulated arm to grasp a refuse receptacle located in front of or on either side of the collection vehicle so that the refuse receptacle can be raised and tilted over the intermediate container in order to empty the contents of the refuse receptacle into the intermediate container. The telescoping assembly, the carriage and the articulated arm are all operated from the cab of the collection vehicle.

In another embodiment of the present invention, the storage body of the refuse collection vehicle includes a plurality of segregated refuse compartments. The intermediate container includes a plurality of bins corresponding to the plurality of refuse compartments. The automated refuse receptacle collection assembly is supported adjacent the plurality of bins of the intermediate container. The automated refuse receptacle collection assembly is configured for engaging a refuse receptacle and is selectively movable so as to dump contents of the refuse receptacle into a selected one of the plurality of bins.

It is an object of the invention to provide a versatile collection apparatus for a front loading refuse vehicle which allows an operator in the cab of the vehicle to move an articulated grasping arm to grip a refuse receptacle located forward of or on the curbside or the streetside of the vehicle, including from cul-de-sac locations.

It is a further object of the invention to provide a collection assembly which may reach out from the refuse collection vehicle to grasp a refuse receptacle near the vehicle and empty the refuse receptacle into an intermediate container carried on the collection vehicle without an operator needing to depart the cab of the vehicle.

These and other objects of the invention will be understood from examination of the detailed description which follows.

BRIEF DESCRIPTION OF THE SEVERAL VIEWS OF THE DRAWING(S)

DETAILED DESCRIPTION OF THE INVENTION

Figure 1:
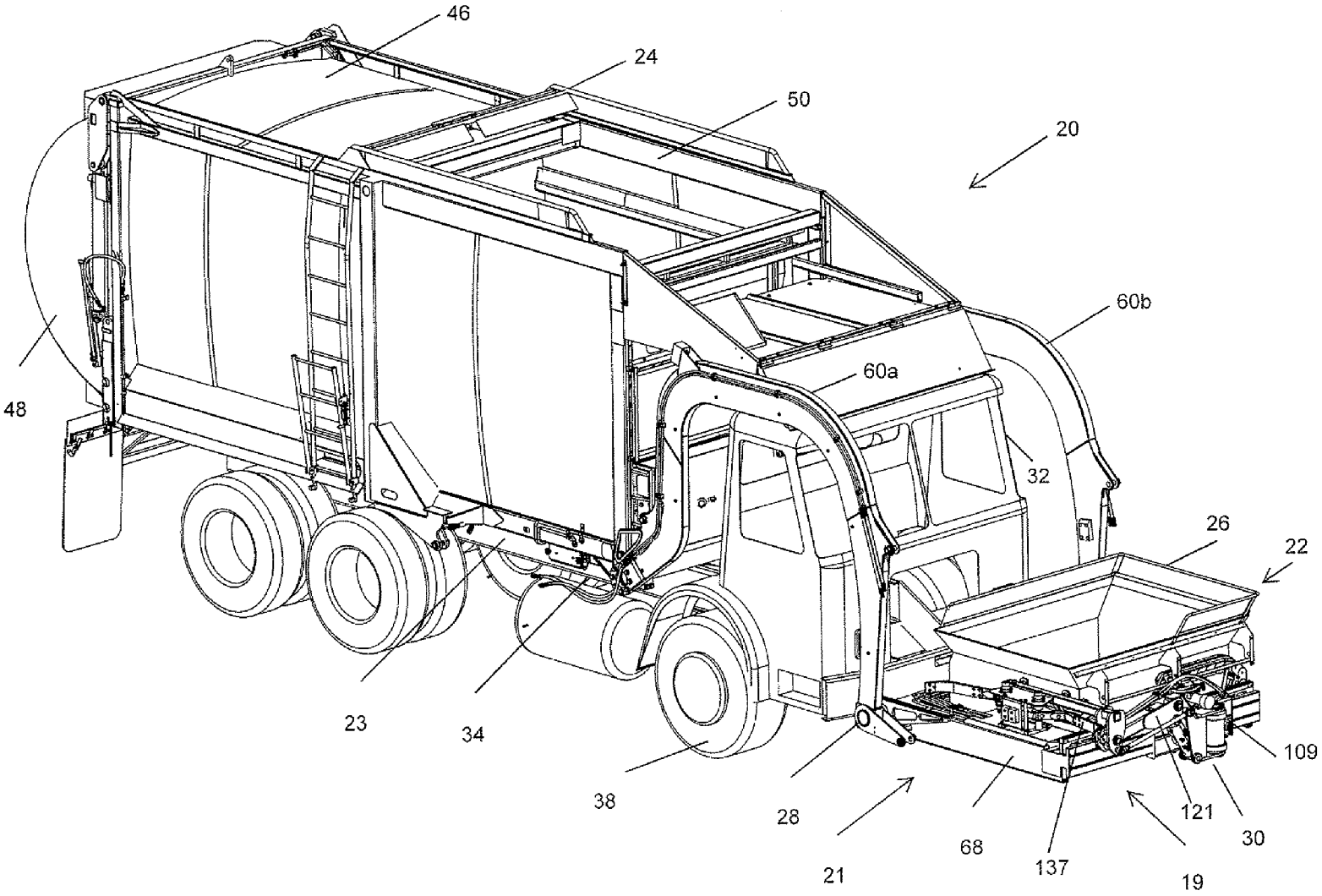
FIG. 1 is a left front perspective of a refuse collection vehicle equipped with the invention.

FIG. 1 is a perspective view of refuse collection vehicle 20 having a curbside 21, a street side 22 and a front side 19. Refuse collection vehicle 20 generally includes chassis 23, storage body 24, intermediate container 26, dumping assembly 28 and automated refuse receptacle collection assembly 30. Chassis 23 may have a variety of configurations depending upon the configurations of storage body 24. Chassis 23 supports and transports storage body 24, intermediate container 26 and dumping assembly 28 between material collection and disposal sites. Chassis 23 further includes cab 32, and wheels 38. Cab 32 is positioned forward of storage body 24 and rearward of intermediate container 26 and refuse receptacle collection assembly 30. Storage body 24 is mounted to and supported by frame 34 and includes storage portion 46, tailgate assembly 48 and intake compartment 50. Storage portion 46 extends between intake compartment 50 and tailgate assembly 48.

Upon release and opening of tailgate assembly 48, refuse stored and contained within storage body 24 may be unloaded therefrom.

Intake compartment 50 of storage body 24 is preferably positioned forward of storage portion 46 and includes at least one compactor assembly (not shown) for moving refuse from intake compartment 50 into storage body 46 while compacting it.

Dumping assembly 28 lifts and empties contents of intermediate container 26 into storage body 24 and generally includes a pair of lifting arms 60*a*, 60*b* which are operated by well known driving devices such as hydraulic cylinders which are controlled by control devices within cab 32 as is conventionally known in the art. Arms 60*a*, 60*b*, when in lowered position as seen in FIG. 1, extend in front of cab 32 to engage and support intermediate container 26 forward of cab 32. Lift arms 60*a*, 60*b* and intermediate container 26 may be lifted upward and rearward of cab 32 to empty the contents of intermediate container 26 into intake compartment 50 of storage body 24.

Intermediate container 26 is preferably supported on arms 60*a*, 60*b* of dumping assembly 28. To unload refuse from intermediate container 26 into storage body 24, dumping assembly 28 lifts intermediate container 26 above and rearward of cab 32 so as to invert intermediate container 26 above intake compartment 50.

Intermediate container 26 includes frame 68 which supports intermediate container 26 upon arms 60*a*, 60*b*. Refuse receptacle collection assembly 30 is supported adjacent intermediate container 26 and is configured for engaging a refuse container located either curbside or street side or at any selected position forward of collection vehicle 20. Carriage 109 of refuse receptacle collection assembly 30 is selectively movable relative to front wall 82 of intermediate container 26 to permit refuse receptacle engagement assembly 137 to reach in any direction, forward of, or at either side of intermediate container 26. Refuse receptacle collection assembly 30 enables an operator within cab 32 to operate the refuse receptacle collection assembly 30 to engage a refuse container, lift the refuse container off the ground, move the refuse container as necessary to sufficiently position the refuse container over intermediate container 26, and to further tilt the engaged refuse container so as to unload the contents of the engaged refuse container into intermediate container 26. As a result, receptacle collection assembly 30 enables the operator to more easily and more efficiently collect refuse contained in refuse receptacles stationed along a roadway or alley, including in cul-de-sac locations.

Figure 2:
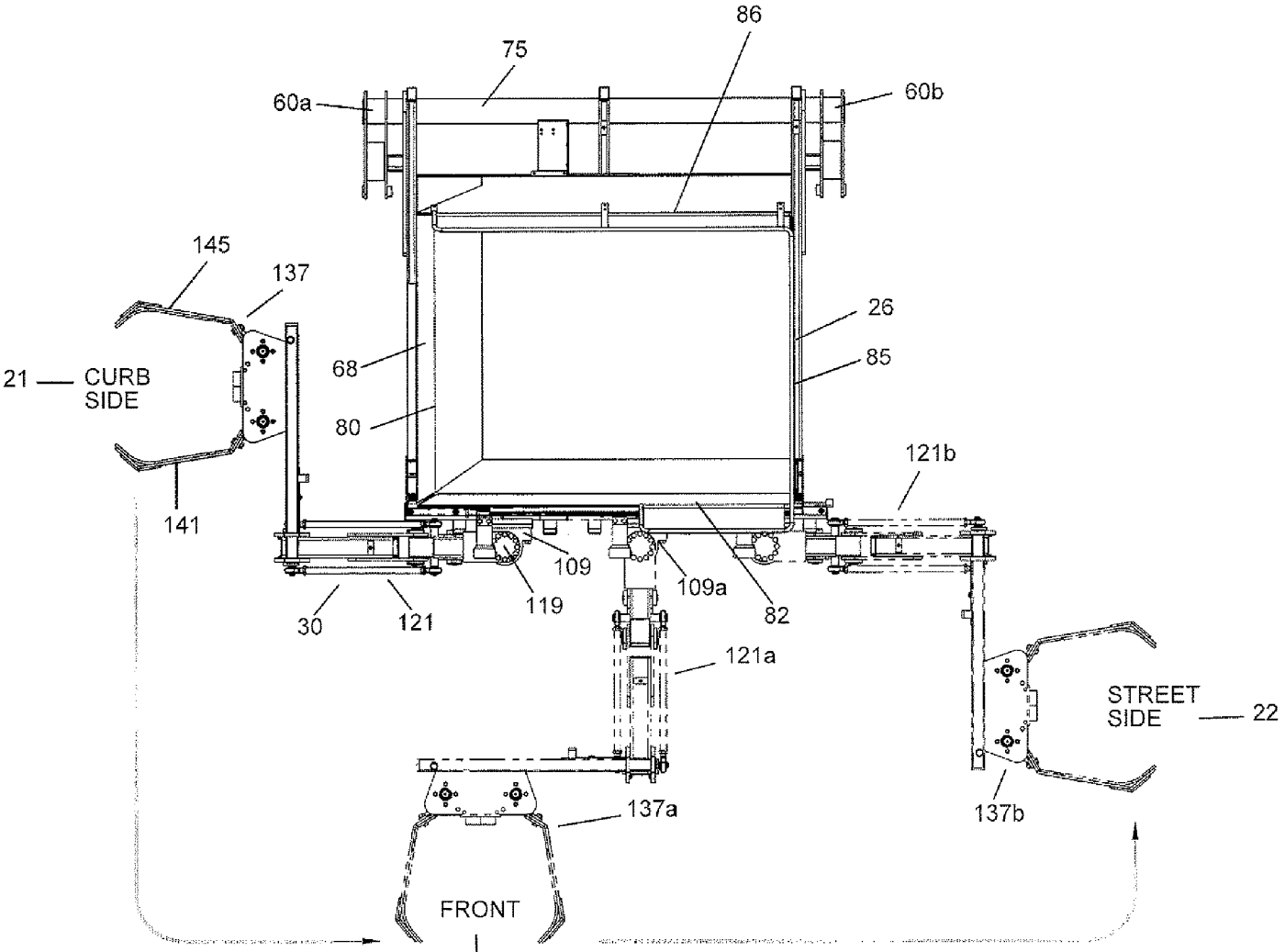
FIG. 2 is a top diagrammatic view of the refuse container collection assembly showing three possible position of the collection assembly among a multiplicity of such positions curbside, street side, or forward of the intermediate container of the refuse container collection assembly.
Figure 4:
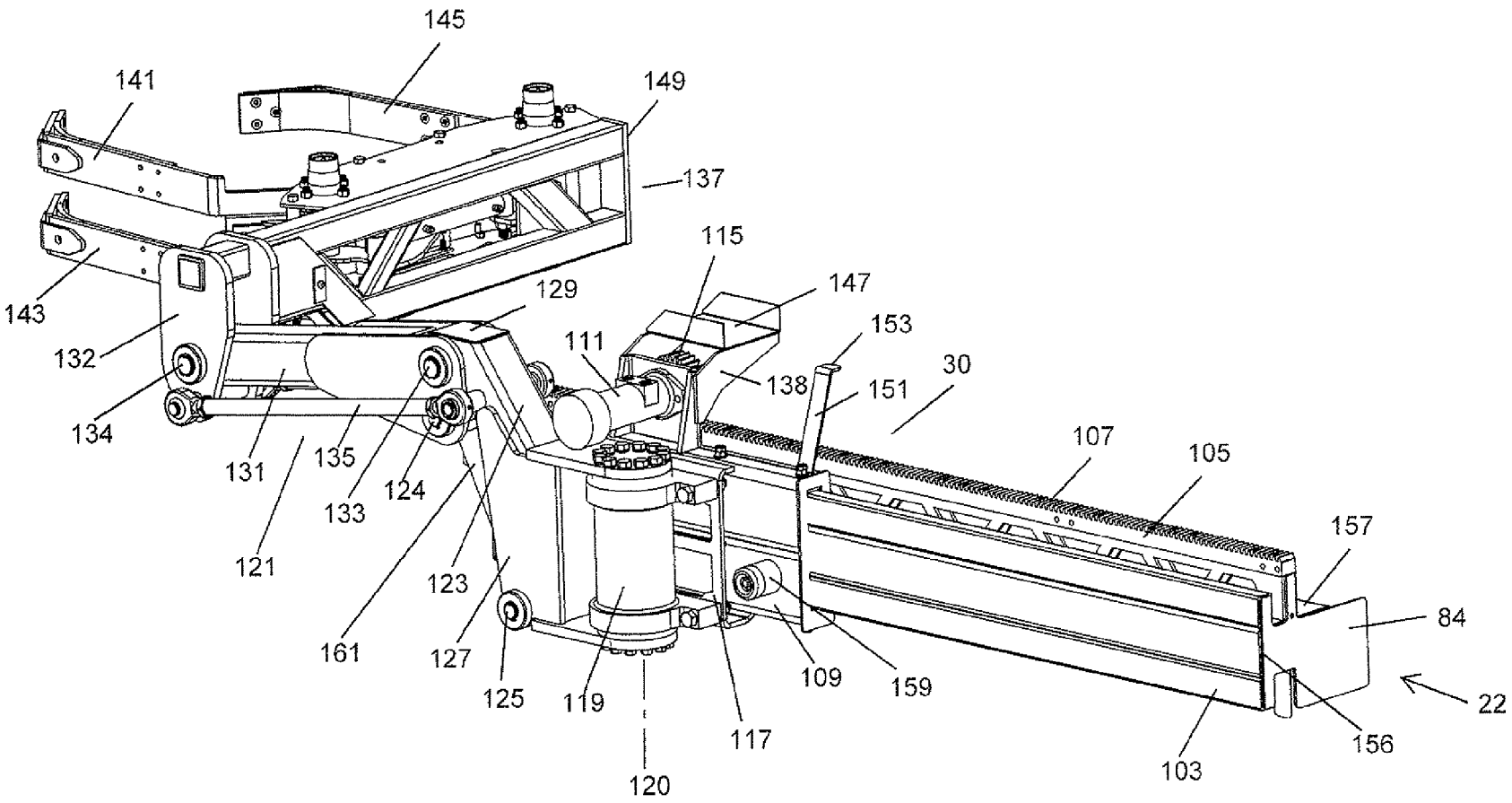
FIG. 4 is a front right perspective view of the collection arm and carriage of the collection apparatus equipped with an alternate embodiment of the refuse receptacle engagement assembly of the invention.

Reference to FIGS. 2 and 4 discloses that the automated refuse receptacle collection assembly 30 comprises a refuse receptacle engagement assembly 137 carried on articulable arm assembly 121 which is supported on carriage 109 by boom support 127 which is supported by rotary actuator 119. Rotary actuator 119 is supported on carriage 109 which is slideably supported on rail 103. Rail 103 is mounted to front wall 82 of intermediate container 26.

Figure 3:
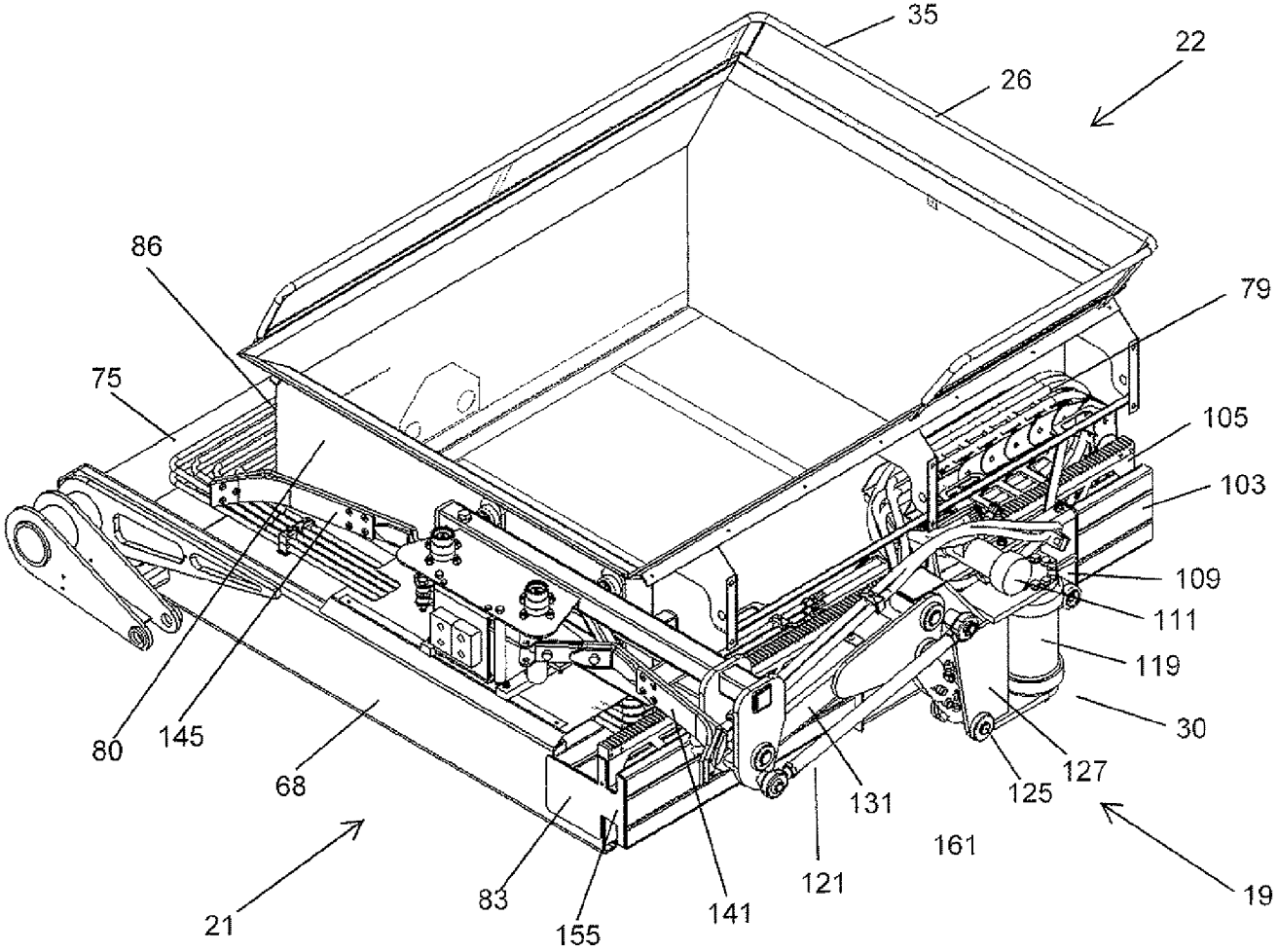
FIG. 3 is a front left perspective view of the collection apparatus mounted on the collector bin.

FIG. 2 illustrates the versatility of refuse receptacle collector assembly 30 by disclosing three of a multiplicity of positions that arm assembly 121 of refuse receptacle collector assembly 30 may occupy relative to intermediate container 26. As shown by solid lines in FIG. 2, arm assembly 121 of refuse receptacle collector assembly 30 may be selectively located with refuse receptacle engagement assembly 137 directed curbside 21. Gripper arms 141, 145 are shown in engagement position as if a consumer refuse receptacle were located between them. Alternatively, arm assembly 121*a*, as shown by dashed lines, may be disposed directly forward of intermediate container 26 with carriage 109*a* generally centered along front sidewall 82 of intermediate container 26. Refuse receptacle engagement assembly 137*a* is directed in a first of a multiplicity of positions at front side 19 of intermediate container 26. Referring also to FIG. 3, it is to be understood that because arm assembly 121 is supported by boom support 127 which is fixed to rotary actuator 119, arm assembly 121 may be located at any position forward of intermediate container 26 over a 180 degree arc, bounded by front wall 82 of intermediate container 26.

In the top view of FIG. 2, it can be seen that intermediate container 26 is joined to lift arms 60*a*, 60*b* by trunnion 75 which is fixed non rotatively to lift arms 60*a*, 60*b*. Frame 68 of intermediate container 26 is immovably fixed to trunnion 75 so that rotation of trunnion 75 will cause intermediate container 26 to rotate with trunnion 75.

Referring now particularly to FIG. 3, the refuse receptacle collector assembly 30 may be seen attached to front sidewall 82 of intermediate container 26 which is supported on collection assembly frame 68. In this figure, refuse receptacle collector assembly 30 is shown with refuse receptacle engagement assembly 137 of refuse receptacle collector assembly 30 stowed alongside curbside sidewall 80 of intermediate container 26, with gripper arms 141, 145 fully retracted. In this stowed position, carriage 109 is generally centered along rail 103. It may be seen that a flex chain 79 is provided to moveably enclose hydraulic hoses 81 and electric cables for protection thereof. Carriage drive apparatus, namely a rotary motor 111, is supported by carriage 109 such that selective rotation of rotary motor 111 will move carriage along rail 103. Toothed gear rack 105 is seen to be disposed between rail 103 and front wall 82 with both rail 103 and gear rack 105 joined at opposing ends by end brackets 83, 84, which are secured to intermediate container frame 68. Rail 103 and rack 105 are each substantially parallel to front wall 82 of intermediate container 26.

Further detail of the novel refuse receptacle collection assembly 30 is illustrated by reference to FIG. 4 along with FIG. 3. Intermediate container 26 is provided with refuse receptacle collection assembly 30 mounted on the front sidewall 82 of intermediate container 26. Refuse receptacle collection assembly 30 includes a substantially horizontal rail 103 mounted to front sidewall 82 of intermediate container 26. Atop rail 103, along substantially the entire length thereof, is rack 105 comprising a series of teeth 107. It is to be noted that carriage 109 is substantially narrower than the width of rail 103, preferably less than one fourth the width of rail 103.

Rail 103 is fixed to intermediate container 26 and extends along a front side wall 82 of intermediate container 26. Rail 103 extends from street side 22 to curbside 21 of intermediate container 26. Rail 103 may project toward curbside 21 past curbside sidewall 80 of intermediate container 26 as seen in FIG. 3 so that carriage 109 may selectively move further toward curbside 21. Rail 103 is preferably located at a lower position on intermediate container 26 so that the top 35 of intermediate container 26 may be extended into intake compartment 50 when intermediate container 26 is inverted by container dumping assembly 28 (shown in FIG. 1). Rail 103 slidably supports carriage 109 adjacent intermediate container 26 and guides movement of carriage 109 between curbside 21 and street side 22.

It is to be understood that attachment of the refuse receptacle collector assembly 30 to front sidewall 82 of intermediate container 26 is only one of the possibilities for mounting of collector assembly 30 on intermediate container 26. Optionally, refuse receptacle collection assembly 30 may be mounted to the rear sidewall 86 of intermediate container 26 provided that frame 68 is expanded to provide sufficient clearance between trunnion 75 and rear sidewall 86.

Because of the narrow width of carriage 109, it is alternatively possible to adapt collection assembly 30 for mounting to curbside sidewall 80 or streetside sidewall 85.

Referring again to FIGS. 3 and 4, mounted upon carriage 109 is hydraulic rotary motor 111 which is oriented on an axis which is substantially perpendicular to rail 103 of refuse receptacle collection assembly 30. Hydraulic rotary motor 111 is oriented substantially horizontally when intermediate container 26 is positioned to receive refuse from a refuse receptacle.

Rotary motor 111 drives pinion gear 115 which mates with rack teeth 107 of rack 105. By operating rotary motor 111 selectively in a clockwise or counterclockwise rotation, carriage 109 may be caused to move along rail 103 to any selected position along the rail 103.

Carriage 109 includes actuator support 117 mounted thereto and actuator support 117 supports rotary actuator 119 which is preferably hydraulically driven and which effects angular rotation of arm assembly 121 about a range of approximately 180 degrees from a position directed curbside 21 to an opposing position directed street side 22. The rotation of rotary actuator 119 is continuous and rotary actuator 119 may be stopped by an operator stationed in the cab 32 at any location within the 180 degree arc.

Rotatably supported on rotary actuator 119 is arm assembly 121 which includes refuse receptacle engagement assembly 137. Arm assembly 121 comprises a boom support 127 which selectively rotates about the substantially vertical axis 120 of actuator 119 when driven by rotary actuator 119. Boom support 127 supports elongate boom 123 which inclines divergingly from the axis 120 of rotary actuator 119.

Pivotally attached to boom 123 at its distal end 129 is elongate arm 131 which interconnects refuse receptacle engagement assembly 137 to boom 123. A tie rod 135 interconnects boom 123 to trip plate 132. It can be seen that arm 131 is pivotable about first axle 133 which fixes arm 131 to distal end 129 of boom 123. Referring particularly to FIG. 4, elevation cylinder 161 can be seen to link first pin 125 to second pin 124 on arm 131. Elevation cylinder 161 is selectively extended or retracted to raise and lower arm assembly 121.

In the embodiment of FIG. 4, refuse receptacle engagement assembly 137 comprises engagement assembly frame 149 and gripper arms 141, 143, and 145. Refuse receptacle engagement assembly 137 may alternatively comprise only opposing gripper arms 141, 145 which would be disposed in opposing alignment with each other instead of being offset as when third gripper arm 143 is utilized. (See FIGS. 6, 7).

Tie rod 135 joins boom 123 to refuse receptacle engagement assembly 137 at trip plate 132 thereof. Selective orientation of gripper arms 141, 143 and 145 about a generally horizontal position is effected by one or more linear drive mechanisms, preferably hydraulic cylinders which are not visible in FIG. 4. Tie rod 135 effects rotation of refuse receptacle engagement assembly 137 as desired as it causes refuse receptacle engagement assembly 137 to rotate about second axle 134.

Carriage 109 supports rotary motor 111 upon shelf bracket 138 which also provides a shelf guide 147 which supports cable track 79 seen in FIG. 3. Detector mount 151 is supported on carriage 109 and supports detector 153 at the free end thereof. Detector 153 detects approach of carriage 109 to the opposing ends 155, 156 of rail 103. Detector 153 may be optical, magnetic, mechanical, or of other configuration. Rack 105 is mounted to front sidewall 82 of intermediate container 26 by box tube 157 such that rack 105 is spaced away from front sidewall 82. End brackets 83, 84 support rail 103 forward of rack 105 and are supported on opposing sides of container frame 68.

Bumper element 159 is mounted to carriage 109 to absorb abutment impacts of boom support 127 upon carriage 109 when arm assembly 121 is moved by rotary actuator 119 to orientation at street side 22.

Refuse receptacle collector assembly 30 comprises actuator support 117 on which rotary actuator 119 is supported in a substantially vertical orientation so that arm assembly 121 will travel in a substantially horizontal plane. Boom support 127 is fixed to actuator frame 117 and it supports boom 123. A first hydraulic cylinder 161 is interposed between first pin 125 of boom support 127 and second pin 124 of intermediate arm 131 such that intermediate arm 131 may be raised and lowered.

Figure 5:
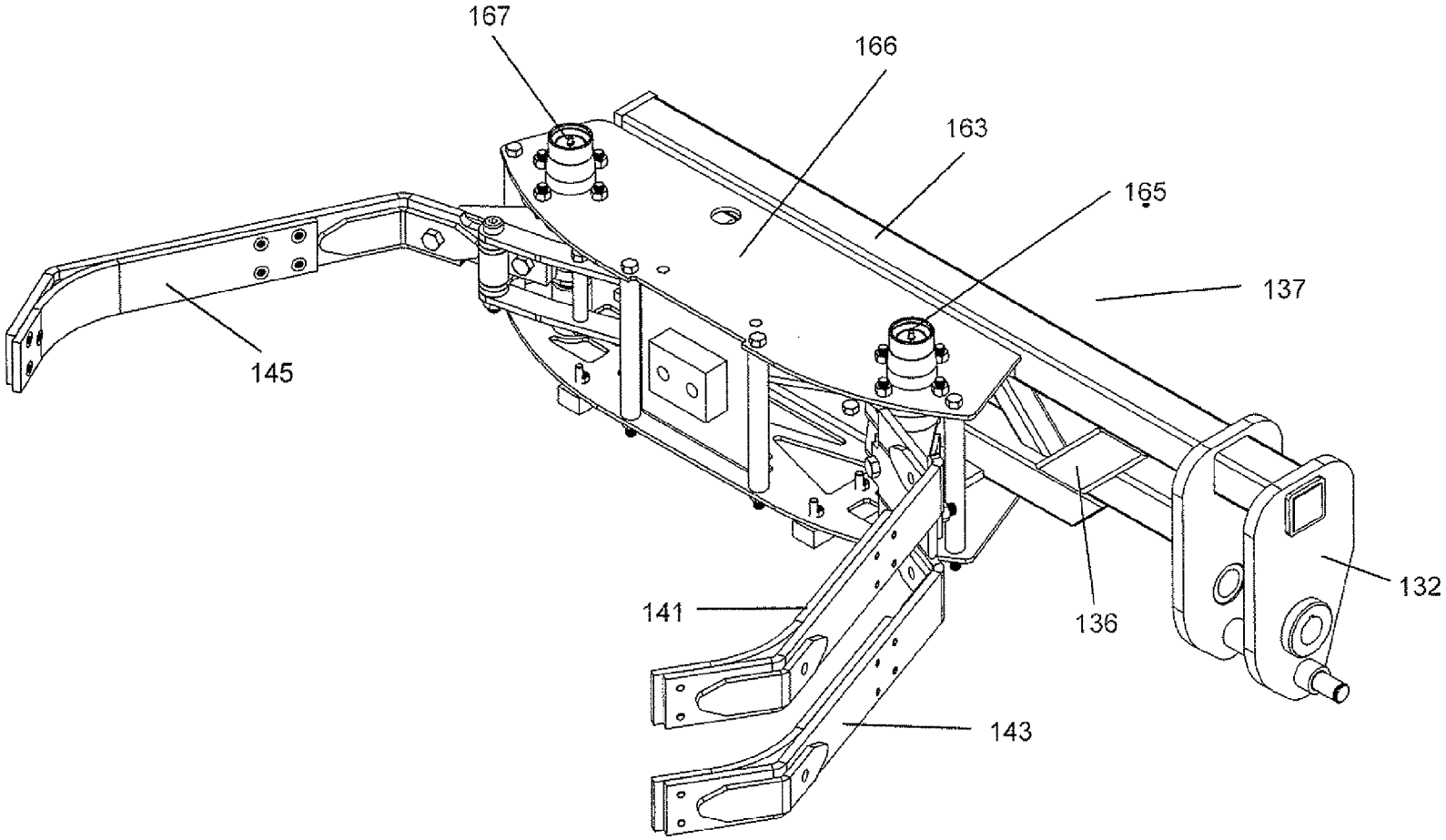
FIG. 5 is an isolated perspective view of the alternative embodiment of the refuse receptacle engagement assembly of FIG. 4.

Referring now to FIG. 5, a first embodiment of refuse receptacle engagement assembly 137 is illustrated, showing that it includes an engagement assembly frame 136 securely fixed to trip plate 132 by frame beam 163. Engagement assembly frame 136 includes linkage cover 166 which overlies a drive cylinder 169 and linkage 170 (see FIG. 8) which are coupled to cause gripper arm 145 to approach gripper arms 141, 143 as they approach gripper arm 145. When not in use, gripper arms 141, 143, 145 can be caused to open to fully separated position when they are rotated divergingly around spindles 165, 167. Gripper arms 141, 143 are offset from and interleave with opposing gripper arm 145 when gripper arms 141, 143, 145 are moved to the closed position.

Figure 6:
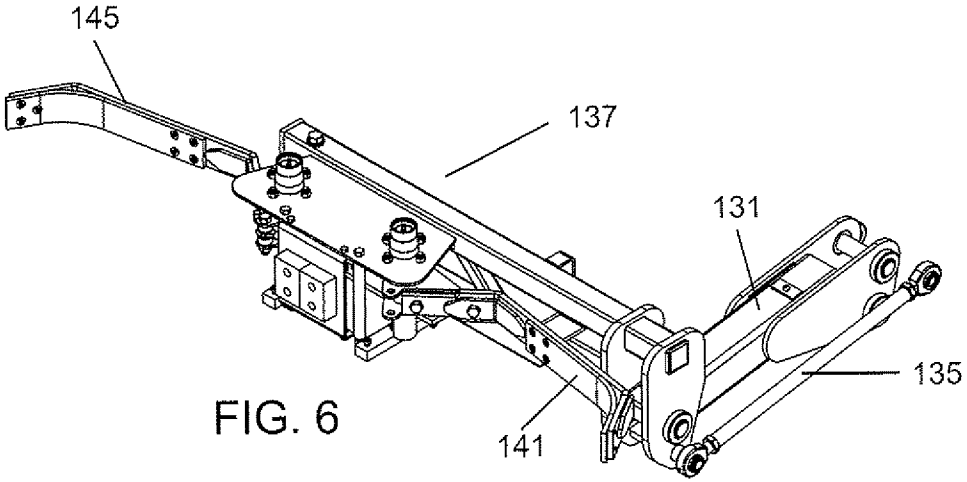
FIG. 6 is perspective of the refuse receptacle engagement assembly of the invention in fully open, stowed configuration.
Figure 7:
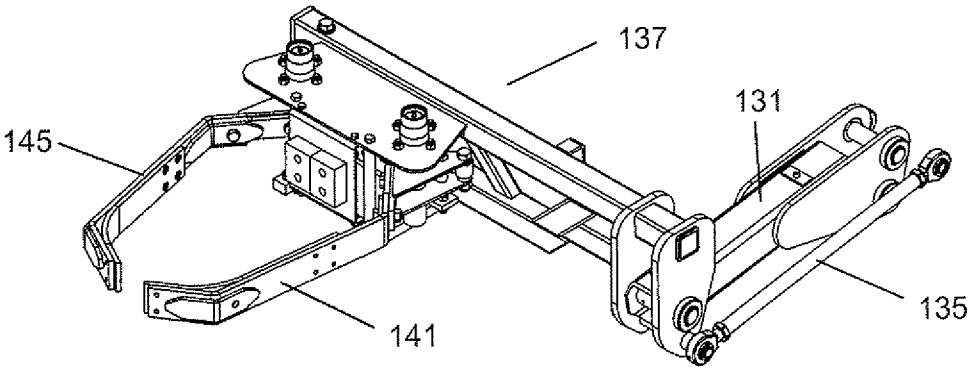
FIG. 7 is perspective of the refuse receptacle engagement assembly of the invention in fully closed, grasping configuration.

The fully separated position of gripper arms 141, 145 as shown in FIG. 6 is utilized when refuse receptacle engagement assembly 137 is stowed alongside intermediate container 26 while the fully closed position of gripper arms 141, 145 is shown in FIG. 7. When only two gripper arms 141, 145 are used, they oppose each other.

Figure 8:
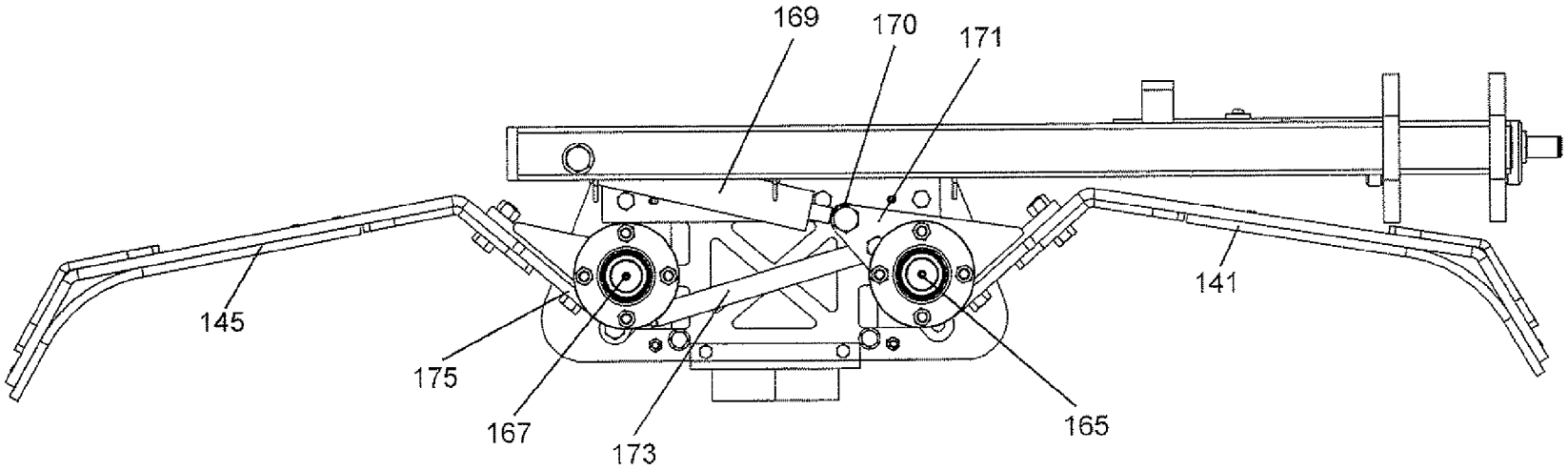
FIG. 8 is a top view of the refuse receptacle engagement assembly isolated from the arm and trip plate, with the gripper arms shown in fully open position for storage alongside the sidewall of the collector bin.
Figure 9:
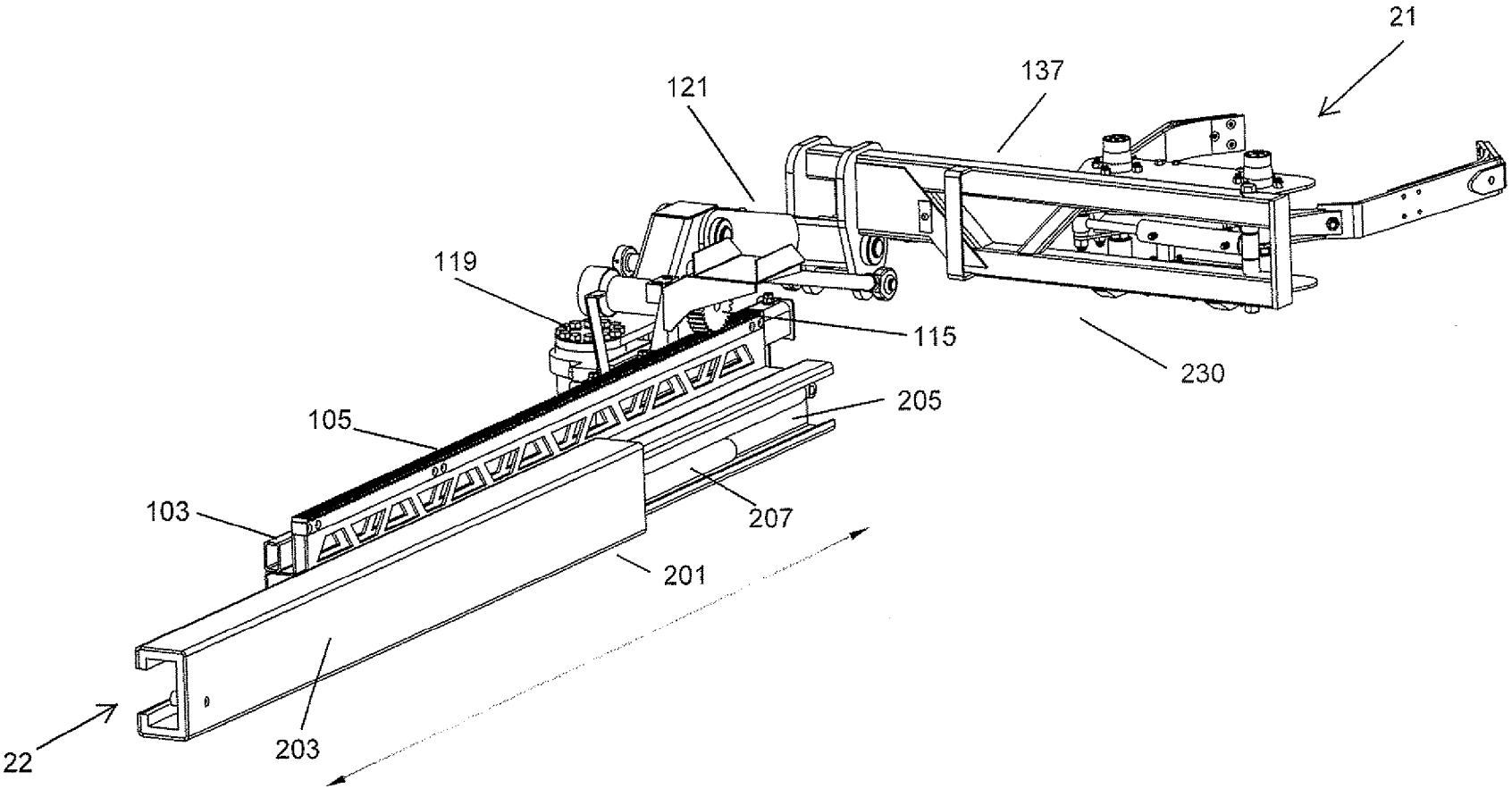
FIG. 9 is a rear perspective of an alternative embodiment of the carriage and arm assembly of the invention isolated from the intermediate container, the alternative embodiment featuring a telescoping element to extend the reach of the refuse receptacle engaging gripper arms.

FIG. 8 discloses the refuse receptacle engagement assembly with the gripper arms 141, 145 fully retracted or open. This figure shows the linkage cover 166 removed such that gripper drive cylinder 169 may be seen extending between frame 163 and first link plate 171 which is coupled to first gripper arm 145 which rotates about first spindle 165. A link arm 173 connects first link plate 171 with base 175 of second opposing gripper arm 141 which rotates about second spindle 167. When space to stow gripper arms 141, 145 in the fully retracted position is available alongside intermediate container 26, it is preferable for the vehicle operator to have the gripper arms 141, 145 ready to enclose about a consumer refuse receptacle 81 without having to first separate the arms from a fully closed position. FIG. 9 depicts an alternative embodiment refuse receptacle collection assembly 230. Elements of the alternative embodiment which are identical in the first embodiment of FIGS. 1-8 are numbered identically for both embodiments. Refuse receptacle collection assembly 230 includes rail 103 mounted along the front wall 82 of the intermediate container 26 by telescoping assembly 201. Telescoping assembly 201 includes an elongate mounting channel 203 which is mounted to the front wall 82 of intermediate container 26 by welding or by mounting bolts. Elongate sliding member 205 is telescopingly slidable within mounting channel 203. Elongate sliding member 205 is slidable over a limited range in either a curbside 21 or street side 22 direction to extend the reach of refuse receptacle engagement assembly 137. Movement of elongate sliding channel member 205 with respect to mounting channel 203 is selectively accomplished by use of a hydraulic cylinders mounted within telescoping assembly 201. Hydraulic cylinder 207 will cause sliding member 205 to extend toward curbside 21. By selective operation of the hydraulic cylinders in telescoping assembly 121, sliding channel member 205 will move either toward curbside 21 or toward street side 22, thereby increasing the reach of refuse receptacle engagement assembly 137. For illustration of an example of such a telescoping assembly, reference is made to FIG. 4 of U.S Pat No. 5,833,428.

Rail 103 is secured to sliding channel member 205 such that rail 103 extends either toward curbside 21 or street side 22 as it moves with second elongate channel member 205.

Arm assembly 121 is supported moveably along rail 103 and its position along rail 103 is controlled by interaction of pinion gear 115 upon linear toothed rack 105. Refuse receptacle engagement assembly 137 is therefore provided an enlarged range of motion by movement of sliding elongate channel member 205 along mounting channel 203.

Preferably all movements are controlled by hydraulic drive fluid supplied by the vehicle 20 on which alternative refuse receptacle collection assembly 230 is supported. Operation of the drive components of automated refuse receptacle collection assembly 230 is accomplished by controls within the cab 32.

Figure 10:
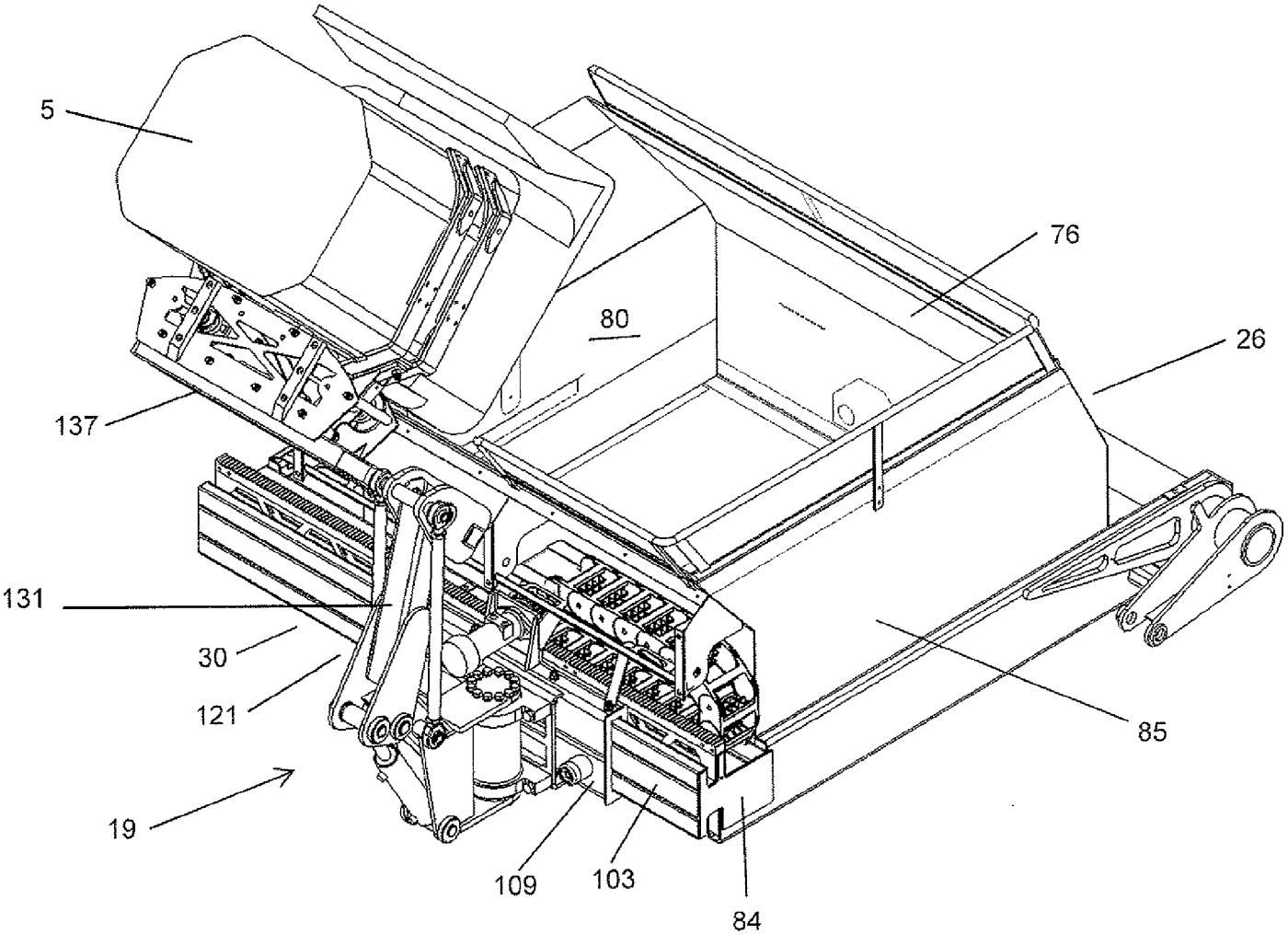
FIG. 10 is a perspective of the preferred embodiment of the refuse receptacle collection assembly grasping a consumer refuse receptacle and tilting it over the open top of the intermediate container from a front position.

FIG. 10 discloses the preferred embodiment of the intermediate container 26 shown with the refuse receptacle engagement assembly 137 of refuse receptacle collection assembly 30 grasping a consumer refuse receptacle 5 and tilting it over the open top 76 of the intermediate container 26 while the elongate arm 131 of arm assembly 121 is oriented substantially parallel to the streetside sidewall 85 at front side 19 of the intermediate container 26. The carriage 109 is located partway along rail 103.

Figure 11:
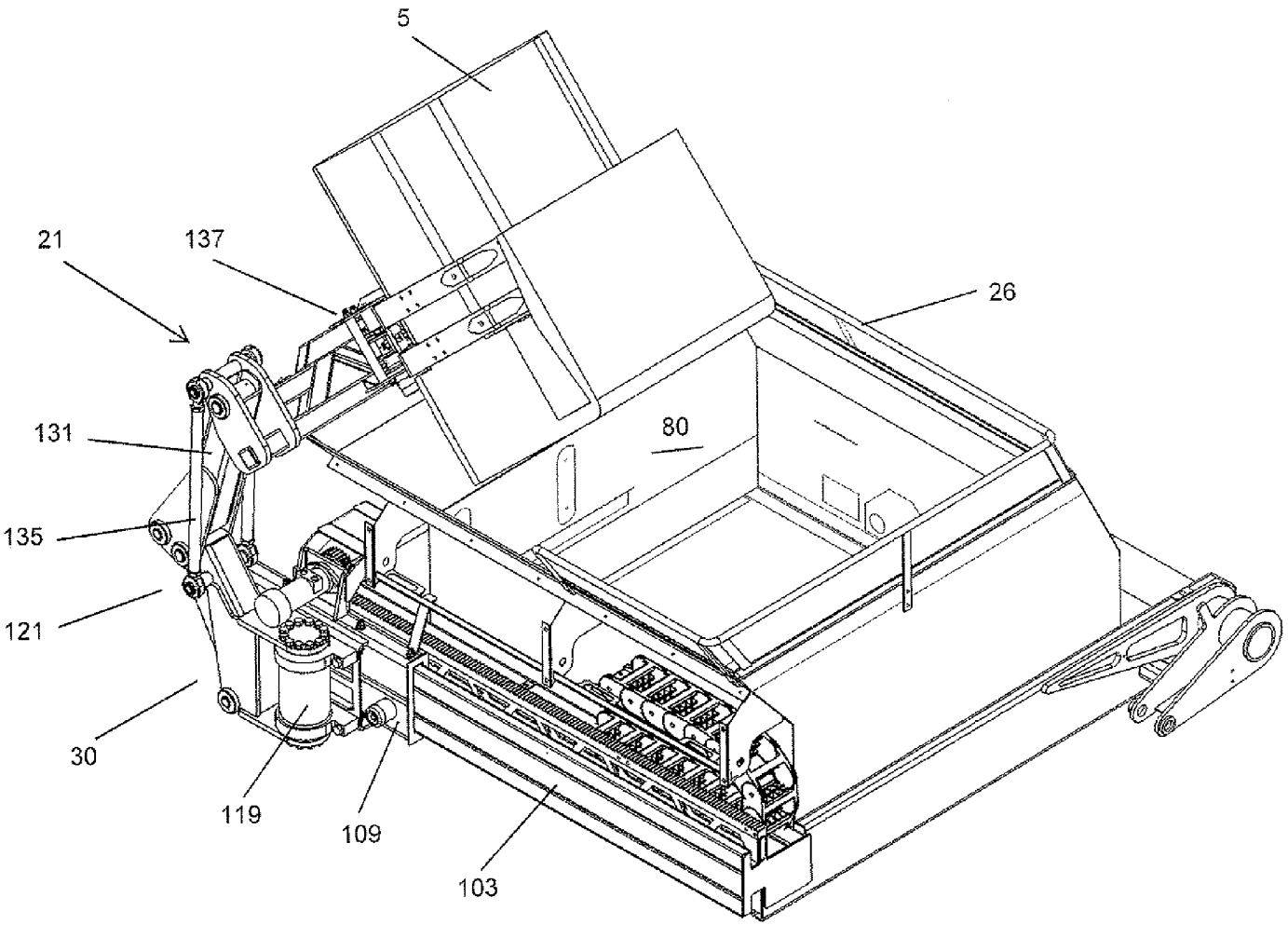
FIG. 11 is a front right perspective view of the intermediate container of the preferred embodiment with the refuse receptacle collection assembly elevating a refuse receptacle and dumping its contents into the intermediate container.

FIG. 11 illustrates the refuse collection assembly including intermediate container 26 with refuse receptacle collection assembly 30 with carriage 109 positioned along rail 103 adjacent curbside 21 of the intermediate container 26. The arm assembly 121 has been positioned by rotary actuator 119 toward curbside 21 and arm 131 has been raised to cause refuse receptacle engagement assembly 137 to elevate refuse receptacle 5 from its rest position while tie rod 135 causes refuse receptacle engagement assembly 137 to tilt refuse receptacle 5 such that its contents will fall into intermediate container 26.

Figure 12A:
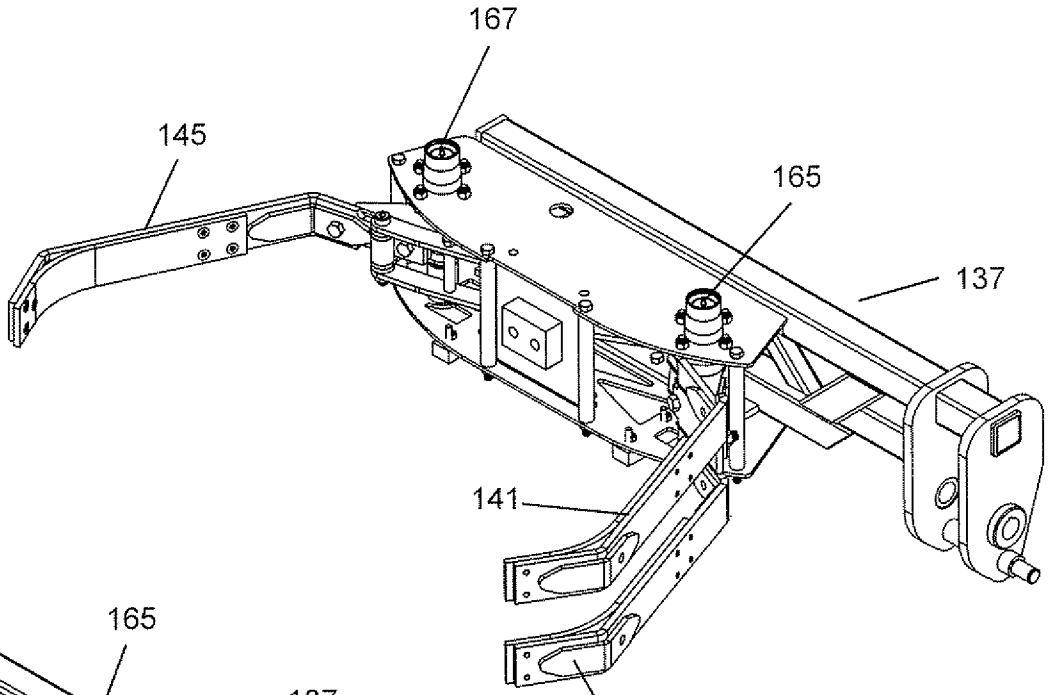
FIG. 12A is a perspective of a refuse receptacle engagement assembly having three gripper arms slightly offset to allow interleaving thereof.
Figure 12B:
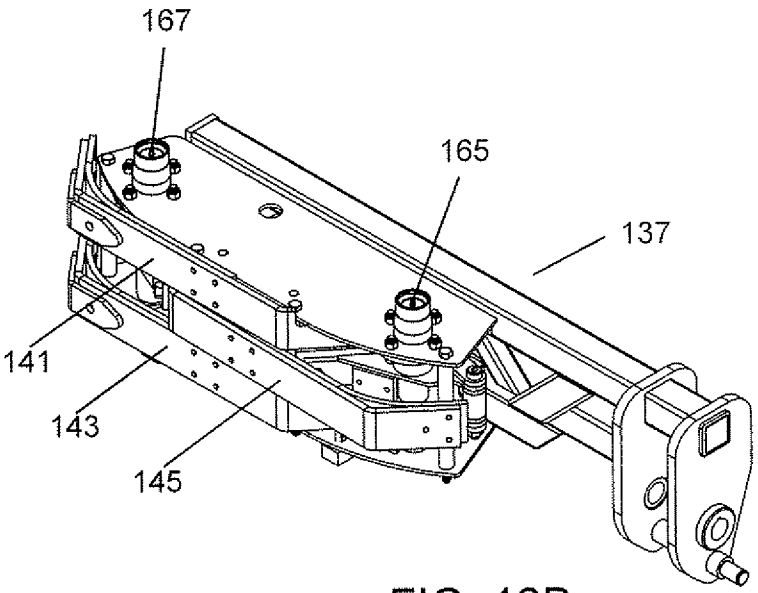
FIG. 12B is a perspective of the refuse receptacle engagement assembly of FIG. 12A with the gripper arms fully interleaved.

FIG. 12A shows the alternative refuse receptacle engagement assembly 137 provided with three gripper arms 141, 143, 145, with gripper arms 141, 143 opposing in offset fashion gripper arm 145 so that gripper arm 145 interleaves with gripper arms 141, 143 when not in use. This embodiment of refuse receptacle engagement assembly 137 may be used when space constraints prevent storage of gripper arms 141, 143, 145 in fully separated position such as is illustrated in FIG. 6 where only opposing gripper arms 141 and 145 are shown in the preferred embodiment of refuse receptacle engagement assembly 137. FIG. 12B illustrates the interleaving of gripper arms 141, 143 with gripper arm 145 when gripper arms 141, 143, 145 have been rotated about spindles 165, 167 respectively, to a fully closed position. Use of a pair of opposing gripper arms 141, 145 as illustrated in FIGS. 6, 7 is usually preferred because the operator of the device need not first spread the arms before grasping a refuse receptacle with them.

Figure 13:
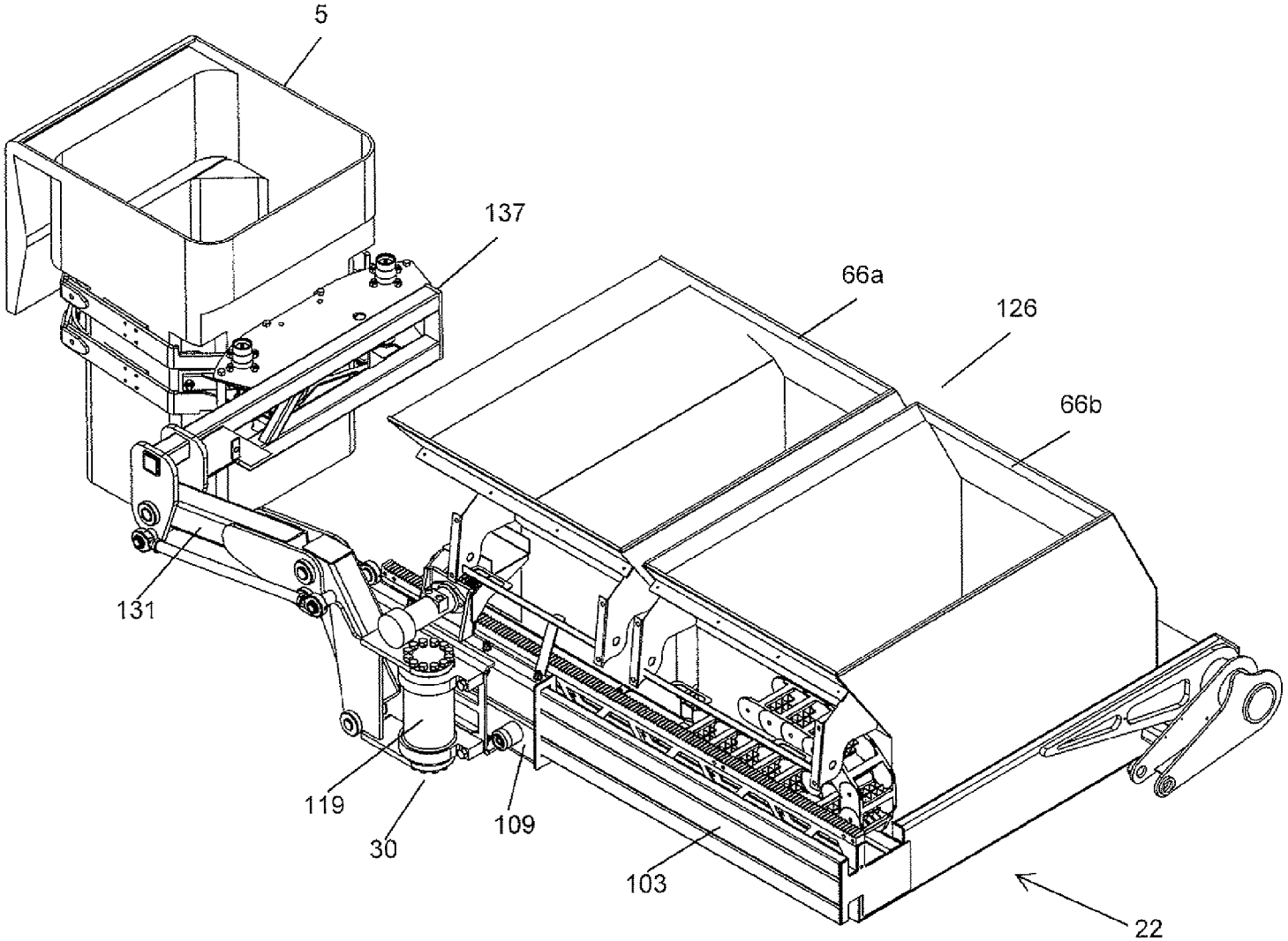
FIG. 13 is a right front perspective of a preferred embodiment of the invention mounted to a pair of side-by-side intermediate containers, the invention holding a refuse receptacle to be emptied into one of the intermediate containers.
Figure 14:
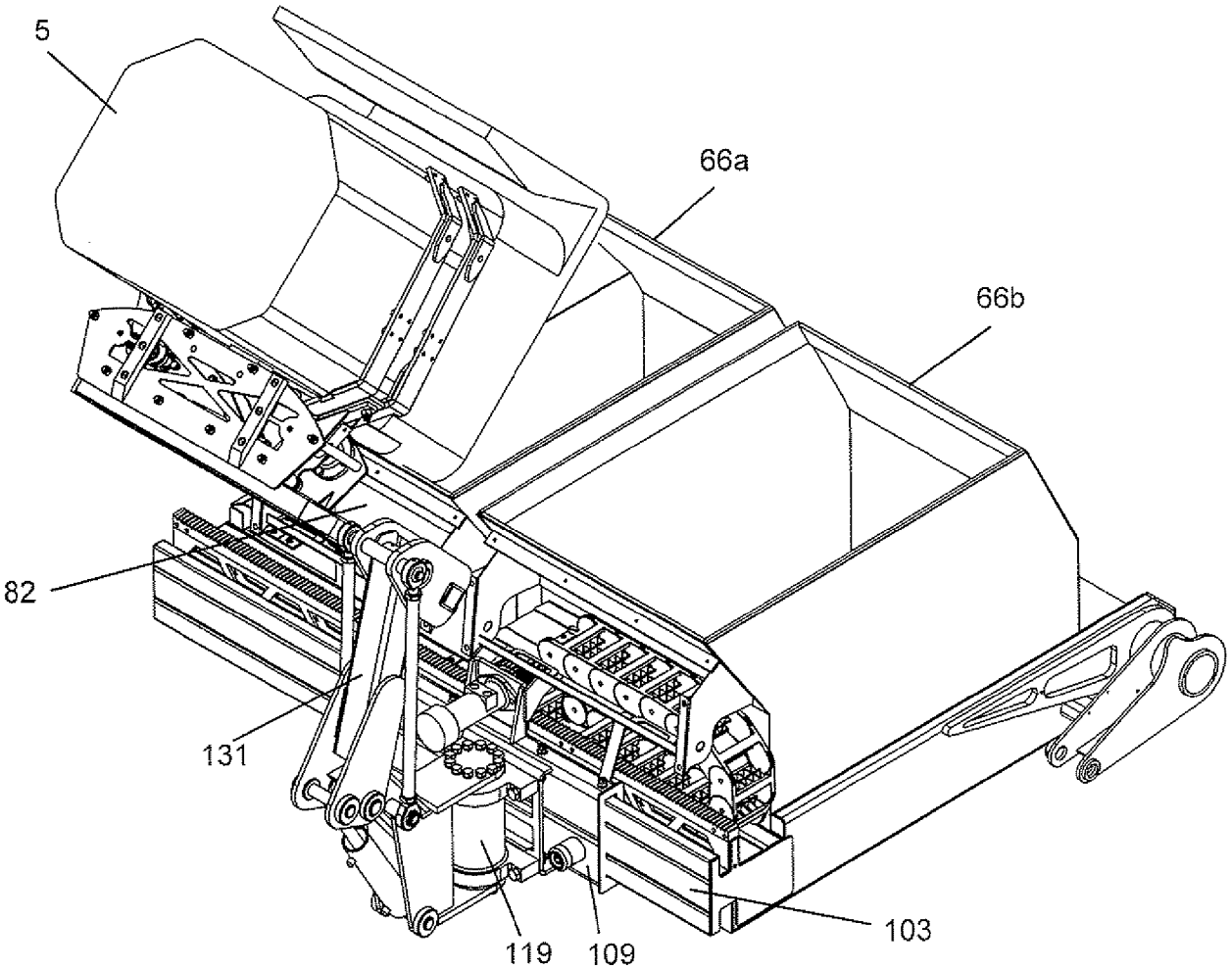
FIG. 14 is a front right perspective of the embodiment of FIG. 13 with a refuse receptacle positioned over a first of the two intermediate containers.

A second alternative embodiment of the invention is illustrated in FIGS. 13 and 14. Reference is made to the disclosure of U.S. Pat. No. 5,833,428 issued Nov. 10, 1998 to Szinte for description of the multiple bin intermediate container disclosed in FIGS. 13-14. The disclosure of U.S. Pat. No. 5,833,428 is incorporated herein.

FIG. 13 discloses second alternative embodiment intermediate container 126 carried on the lift arms 60*a*, 60*b* (see FIG. 1) of a front loading refuse collection vehicle 20, the intermediate container 126 supporting a loading and dumping apparatus 30 for grasping a refuse receptacle and lifting and tilting the refuse receptacle to partially invert the refuse receptacle over the open top of one of multiple compartments of the intermediate container. The loading and dumping apparatus 30 is identical to automated refuse receptacle collection assembly 30 of FIGS. 1-10 and the parts thereof are referenced with identical numbers. FIG. 13 depicts the invention having grasped a refuse receptacle 5 by refuse receptacle engagement assembly 137 and lifted it from its rest position in preparation for further elevation by movement of arm 131 upward and its tilting and the dumping of its contents into first bin 66*a*. Carriage 109 carried on rail 103 may be selectively moved toward street side 22 and arm assembly 121 relocated by rotary actuator 119 when it is desired to empty the contents of refuse receptacle 5 into second bin 66*a* over front wall 82 as seen in FIG. 14.

In operation, refuse collection vehicle 20 enables an operator to quickly and efficiently collect refuse contained in receptacles without extensive manual or physical labor. In particular, by selective control of refuse receptacle collection assembly 30, an operator may collect a refuse receptacle from a multitude of locations with respect to the refuse collection vehicle. For example, by selective movement of carriage 109, the operator may collect refuse receptacles located forward of or at curbside or at street side of intermediate container 26. By selective movement of rotary actuator 119, the operator may direct the refuse receptacle engagement assembly 137 in various directions to collect refuse receptacles located anywhere within the 180 degree range of arm assembly 121. By selectively moving both carriage 109 and arm assembly 121, the operator can collect refuse receptacles at any location within the reach of the arm assembly 121 over the range of 180 degrees forward of front wall 82 of container 26 from curbside 21 to street side 22. Furthermore, by selective movement of arm 131, the operator may collect refuse receptacles supported and stored at different horizontal levels by raising and lowering the refuse receptacle engagement assembly 137.

Once a refuse receptacle has been engaged by refuse receptacle engagement assembly 137, unloading the receptacle into intermediate container 26 is easily completed by selective actuation of carriage 109 and rotary actuator 119. If intermediate container 26 is divided into a plurality of bins 66 as shown in FIGS. 13 and 14, for segregating refuse types, the operator may selectively dump contents of the refuse receptacle 5 into a selected one of the plurality of bins 66 by selective movement of carriage 109 and rotary actuator 119. As a result, engaging a refuse receptacle 5 and unloading the refuse receptacle 5 into a selected bin 66*a*, 66*b* may be easily performed without the necessity of the operator leaving the cab of the refuse collection vehicle 20.

Once the contents of the refuse receptacle have been unloaded into intermediate container 26, the operator may selectively reposition the empty refuse receptacle at the previous position or at a new position by selective movement of carriage 109 and rotary actuator 119. After the refuse receptacle has been lowered and released by selective actuation of arm assembly 121 and refuse receptacle engagement assembly 137, arm assembly 121 and refuse receptacle engagement assembly 137 may be compactly stored adjacent intermediate container 26 to avoid obstruction of the operator's view while unloading intermediate container 26 into refuse collection vehicle and while driving refuse collection vehicle 20. In particular, gripper arms 141 and 145 may be easily fully retracted for compact storage.

As can be appreciated, refuse collection assembly 30 may be used with a variety of refuse collection vehicles. For example, refuse collection assembly 30 may alternatively be used with a refuse collection vehicle 20 having a single or multiple storage compartments. Refuse receptacle collection assembly 30 may alternatively be mounted to an intermediate container located adjacent a side of the refuse collection vehicle or at a rear of the refuse collection vehicle.

Furthermore, as can be appreciated, refuse collection assembly 30 may have a variety of alternative configurations. For example, refuse receptacle collection assembly 30 may also be oppositely configured for extending around and parallel to street side 22 of intermediate container 26. The arm actuator mechanism 121 may include any one of a variety of well-known equivalent mechanical and structural configurations to provide the same function with the same particular range of motion.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

Having described the invention, we claim:

1. A refuse collection assembly for collecting refuse contained in a refuse receptacle comprising:

an intermediate container having an open top and a front wall, the intermediate container adapted to be carried on front lift arms of a refuse collection vehicle and selectively emptied into a collection body of the collection vehicle, a refuse receptacle collection assembly supported alongside the intermediate container, the refuse receptacle collection assembly configured for selectively grasping the refuse receptacle and dumping contents of the refuse receptacle into the open top of the intermediate container, the refuse receptacle collection assembly comprising a stationary elongate member, a carriage selectively longitudinally movable along the stationary elongate member, and an arm assembly supported on the carriage, the arm assembly being selectively pivotable about a substantially vertical pivot element supported on the carriage, the elongate stationary member adjacent the front wall of the intermediate container, the elongate stationary member having a horizontal length, the carriage having a horizontal width less than approximately one fourth the horizontal length of the elongate stationary member, the carriage selectively positionable along the stationary elongate member by operation of a first drive member, the first drive member carried on the carriage;

the elongate stationary member supported on the front wall of the intermediate container, the first drive member is a rotary motor, the refuse receptacle collection assembly further comprising an elongate toothed member supported by the front wall of the intermediate container, the elongate toothed member parallel to and spaced laterally apart from the stationary elongate member, the elongate toothed member disposed between the stationary elongate member and the front wall of the intermediate container, the elongate toothed member having teeth thereon engaged with a gear of the rotary motor.

2. The refuse collection vehicle of claim 1 wherein— the carriage includes a rotary actuator having a generally vertical axis, the arm assembly coupled to the rotary actuator, the rotary actuator selectively operable to pivot the arm assembly about the pivot element to any location over at least a 180 degree arc, the rotary actuator being a first hydraulic motor.

3. The refuse collection vehicle of claim 1 wherein— the refuse receptacle collection assembly is supported on the intermediate container, the first drive member is a first hydraulic rotary motor, the refuse receptacle collection assembly further comprises an elongate toothed member supported by the front wall of the intermediate container, the elongate toothed member parallel to and spaced laterally apart from the stationary elongate member, the elongate toothed member disposed between the stationary elongate member and the front wall of the intermediate container, the elongate toothed member having teeth thereon engaged with a gear of the first hydraulic rotary motor, the carriage includes a rotary actuator having a generally vertical axis, the axis of the rotary motor being coincident with the substantially vertical pivot element, the arm assembly coupled to the rotary actuator, the rotary actuator selectively operable to pivot the arm assembly about the pivot element to any location over at least a 180 degree arc, the rotary actuator being a second hydraulic motor.

4. A refuse collection assembly for collecting refuse contained in a refuse receptacle comprising:

an intermediate container having an open top and a front wall, the intermediate container adapted to be carried on front lift arms of a refuse collection vehicle and selectively emptied into a collection body of the collection vehicle, a refuse receptacle collection assembly supported alongside the intermediate container, the refuse receptacle collection assembly configured for selectively grasping the refuse receptacle and dumping contents of the refuse receptacle into the open top of the intermediate container, the refuse receptacle collection assembly comprising a stationary elongate member, a carriage selectively longitudinally movable along the stationary elongate member, and an arm assembly supported on the carriage, the arm assembly being selectively pivotable about a substantially vertical pivot element supported on the carriage, the elongate stationary member adjacent the front wall of the intermediate container, the elongate stationary member having a horizontal length, the carriage having a horizontal width less than approximately one fourth the horizontal length of the elongate stationary member, the carriage selectively positionable along the stationary elongate member by operation of a first drive member, the first drive member carried on the carriage, the refuse receptacle collection assembly is supported on the intermediate container, the first drive member is a first hydraulic rotary motor, the refuse receptacle collection assembly further comprises an elongate toothed member supported by the front wall of the intermediate container, the elongate toothed member parallel to and spaced laterally apart from the stationary elongate member, the elongate toothed member disposed between the stationary elongate member and the front wall of the intermediate container, the elongate toothed member having teeth thereon engaged with a gear of the first hydraulic rotary motor, the carriage includes a rotary actuator having a generally vertical axis, the axis of the rotary motor being coincident with the substantially vertical pivot element, the arm assembly coupled to the rotary actuator, the rotary actuator selectively operable to pivot the arm assembly about the pivot element to any location over at least a 180 degree arc, the rotary actuator being a second hydraulic motor.

* * * * *